US005612102A

United States Patent [19]

Nakama

[11] Patent Number: 5,612,102

[45] Date of Patent: Mar. 18, 1997

[54] FACETED JEWELRY ORNAMENT WITH FACET GROOVED FOR LIGHT DIFFRACTION

[75] Inventor: Hiroshi Nakama, Kanagawa-ken, Japan

[73] Assignee: Yamato Kako Kabushiki Kaisha, Japan

[21] Appl. No.: 175,560

[22] Filed: Dec. 30, 1993

[30] Foreign Application Priority Data

Oct. 13, 1993 [JP] Japan ..... 5-255951

[51] Int. Cl.[6] ..... A44C 17/00

[52] U.S. Cl. ..... 428/15; 63/32; 428/187; 428/426

[58] Field of Search ..... 428/7, 15, 187, 428/426; 63/32

[56] References Cited

U.S. PATENT DOCUMENTS

| | | | |
|---|---|---|---|
| 2,081,483 | 5/1937 | Haltom | 63/32 |
| 2,511,510 | 6/1950 | Mukai | 63/32 |
| 3,796,065 | 3/1974 | Watermeyer | 63/32 |
| 4,020,649 | 5/1977 | Grossbard | 63/32 |
| 4,030,317 | 6/1977 | Rogell | 428/15 X |
| 4,809,417 | 3/1989 | Normann, Jr. | 428/187 X |
| 5,044,123 | 9/1991 | Hoffman | 451/180 |
| 5,123,265 | 6/1992 | Ramot | 63/32 X |
| 5,419,159 | 5/1995 | Muller | 63/28 |

FOREIGN PATENT DOCUMENTS

| | | |
|---|---|---|
| 52-147170 | 12/1977 | Japan . |
| 4711241 | 6/1992 | Japan . |
| 70-8135 | 6/1972 | South Africa . |

*Primary Examiner*—Henry F. Epstein
*Attorney, Agent, or Firm*—Lorusso & Loud

[57] ABSTRACT

The present invention provides an ornament composed of a light transmissive material having a plurality of facets, with a plurality of fine grooves formed on these facets to increase brilliancy, dispersion and scintillation effects and thereby enhance the ornamental appearance.

13 Claims, 6 Drawing Sheets at incident angle of 10° at incident angle of 89°

FACETED JEWELRY ORNAMENT WITH FACET GROOVED FOR LIGHT DIFFRACTION

BACKGROUND OF THE INVENTION

The present invention relates to improvement of appearance of a transparent ornament, and more specifically to heightening of value as an ornament by increasing glitter through increase in transmission and reflection of light internally of the transparent ornament material, such as glass or the like.

Diamonds are commonly used in jewelry. The reason why the diamond holds the highest position among gemstones is due to the fact that the diamond itself has excellent features such as transparency and a high refractive index and because the reflected quantity of light and the refraction state of light can be delicately varied by changing the method of cutting. The brilliant-cut is presently considered to more eminently show the splendid beauty of a diamond than any other method of cutting, such as the square-cut or the emerald-cut.

The beauty of a brilliant-cut diamond is attributable to the large quantity of total reflection. Due to a high refractive index, the total reflection area and total reflection quantity are large. Hence, a diamond shines with what is known as brilliancy. The total reflection light is dispersed due to the difference of the refractive index in accordance with oscillation frequencies of respective colors and broken into seven colors. This rainbow of seven colors is known as "fire." Furthermore, the light totally reflected from the facet planes moves, while glittering, every time the diamond moves or the eyes of the observer move. This latter phenomenon is called scintillation. By means of the brilliant-cut, brilliancy, dispersion and scintillation are maximized, thus enhancing the beauty of the diamond.

One prior art approach for improving the beauty of a diamond is that disclosed in Republic of South Africa Patent Application Number 7018135 (corresponding to Japanese Patent Provisional Publication Number 47-11241) filed Dec. 1, 1970, and entitled "A Cut Diamond and A Cut Method thereof". In this invention, a square-cut method is adopted to improve the yield from the rough diamond.

U.S. patent application Ser. No. 690,401, filed May 27, 1976 (now U.S. Pat. No. 4,020,649) (corresponding to Japanese Patent Provisional Publication Number 52-147170) and entitled "Cut Jewel Made Brilliant" relates to a hybrid-cut method for combining the advantages of the square-cut method in maximizing raw material yield of the rough diamond and of the brilliant-cut method in imparting superior brilliancy to a diamond.

Japanese Patent Application Number 254360 filed on Sep. 29, 1989 (Laid-Open Number 3-115582) is entitled "Method of Coating Precious Metals on Diamond" and describes a method of coating precious metals on a diamond.

However, no technique for improving the ornamental appearance of a light transmission material has been known up to now, other than variations of the cut and precious metal coating.

SUMMARY OF THE INVENTION

The present invention is an ornament composed of a light transmissive material having a plurality of facets, with fine grooves formed on at least one of the cut facets.

Diffraction of light occurs when the spacing between fine grooves is 0.1 μm to 1,000 μm.

Diamond, glass, plastic, cubic zirconia and the like are typical light transmissive materials which, when cut into jewels, exhibit light diffraction.

When different patterns of fine grooves are formed on different areas of a cut facet of the light transmissive material, it is possible to obtain various additional ornamental effects.

Suitable patterns include, for example, fine grooves in parallel lines, concentric circles, waveforms and combinations of parallel lines, concentric circles and waveforms, each producing a different ornamental behavior of light.

A cut facet of a light transmissive material may be optionally carved to define different areas, but special brilliancy is achieved when these respective areas extend radially from the center of the facet, for example, as seen in FIG. 3.

When fine grooves are formed on at least one cut facet of the light transmissive material, diffraction is generated at that cut facet. Further, when brilliant-cut the light transmissive material exhibits an ornamental effect which is enhanced by being combined with the brilliancy, dispersion and scintillation, from reflection and refraction of light, originating in this cut.

When a material such as diamond, glass, plastic or cubic zirconia is used as the light transmissive material, the ornament shines more beautifully due to the transparency thereof.

When the patterns of fine grooves formed on the cut facets of the light transmissive material are different for different areas on the cut facets, the diffraction by the fine grooves differs between the respective areas. Thus, a specific color may be particularly emphasized at the cut facet or patterns of various colors may be evident, and furthermore, brilliancy, dispersion and scintillation are also seen.

By forming the pattern of fine grooves in parallel lines, concentric circles or waveforms, it is possible to change the diffraction of the light.

When respective areas carved out on the cut facet of the light transmissive material are formed radially, it is possible to show a crisscross pattern displaying a specific color on the cut facet.

DESCRIPTION OF THE PREFERRED EMBODIMENTS

Embodiments of the present invention will be described hereinafter with reference to the drawings.

The effect of the present invention can be confirmed only experimentally. It is considered that the effect is shown most eminently in a diamond, but brilliant-cut cubic zirconia of 0.5 carat is used in the experiments reported below for sake of convenience.

Cubic zirconia is obtained by adding a stabilizer such as $Y_2O_3$ to cubic zirconium oxide and has an appearance closely resembling that of a diamond. Therefore, it is used as a substitute for a diamond herein.

TABLE 1 shows physical characteristics of diamond and cubic zirconia.

TABLE 1

| | Diamond | Cubic Zirconia |
|---|---|---|
| Mohs' hardness | 10 | 7.5–8.5 |
| Density | 3.52 | 6 |
| Refractive index | 2.417 | 2.16 |
| Double refraction | 0 | 0 |
| Degree of dispersion | 0.044 | 0.06 |

Figure 4:
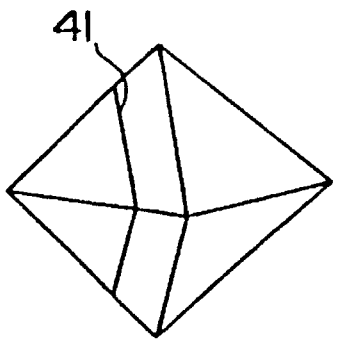
FIGS. 4(*a*)–4(*f*) illustrate the steps in forming a brilliant-cut.
Figure 4:
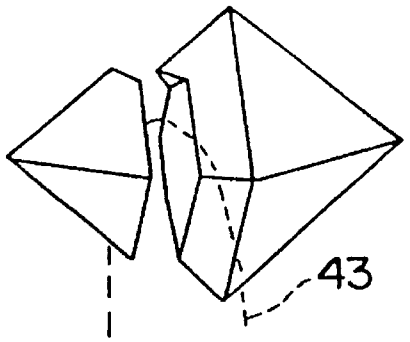
Figure 4:
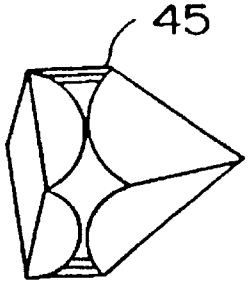
Figure 4:
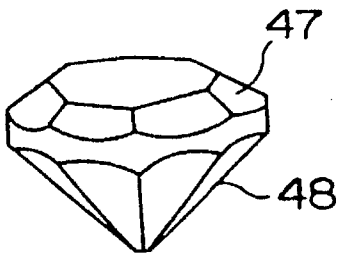
Figure 4:
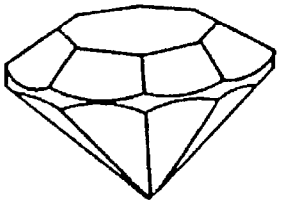
Figure 4:
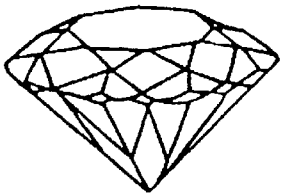

Further, the brilliant-cut is known as maximizing the brilliancy of a diamond and is applied to the cubic zirconia used in the experiments of the present invention. The cut will be described hereinafter with reference to FIG. 4.

The brilliant-cut is completed by processing through various processes of (a) inking 41, (b) scribing 43, (c) rounding 45, (d) blocking 47 and reguard ring 48, (e) main-facet-cut and (f) other facet-cut.

Figure 5:
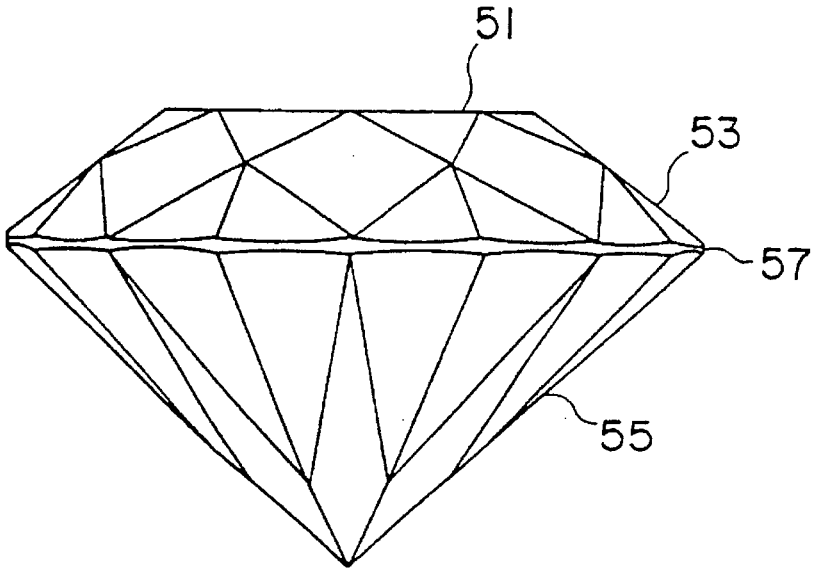
FIG. 5(*a*) is an elevational view of a brilliant-cut jewel, and FIG. 5(*b*) is a plan view of the brilliant-cut jewel of FIG. 5(*a*)
Figure 5:
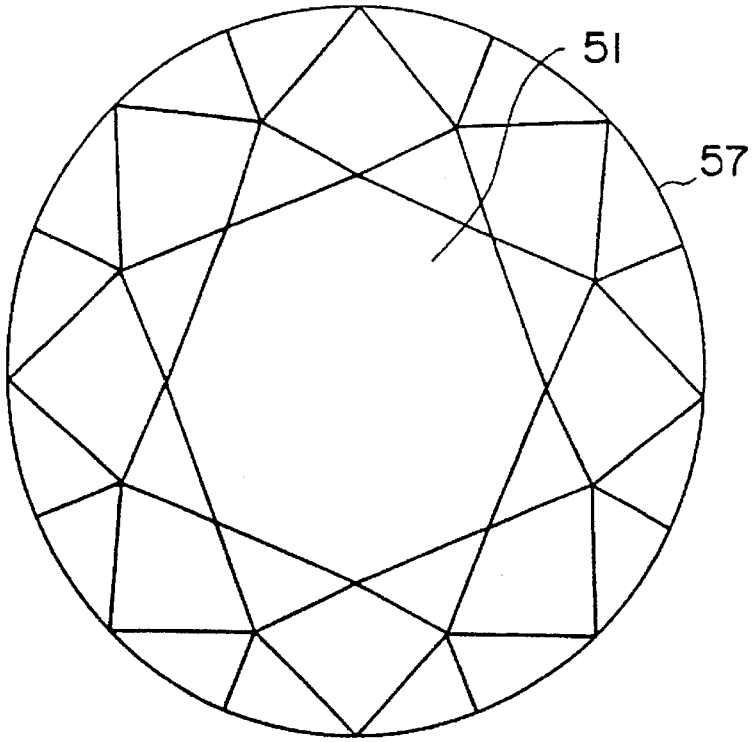

FIG. 5 shows in detail a completed brilliant-cut. FIG. 5(*a*) and FIG. 5(*b*) show, respectively, a front view and a plan view of a brilliant-cut.

The top face represented by reference numeral 51 seen in FIG. 5(*a*) is called a "table", and inclined faces represented by reference numeral 53 extend approximately 3/10 of the whole height downward from the peripheral edge of the table 51. These inclined faces together form what is called the "crown". Extending over the remaining height of approximately 7/10, separate inclined faces represented by a reference numeral 55, in which the dimension parallel to the table decreases gradually so as to converge, are formed. These inclined faces are called a "pavilion". A "girdle" 57 is provided between the crown 53 and the pavilion 55. The girdle 57 appears as a circle in the plan view of FIG. 5(*b*).

The shining of a diamond is called "brilliancy", and is due to total reflection of light therein. A diamond has a refractive index of 2.42, which is a very high value as compared with that of other jewels such as 1.55 for crystal and 1.77 for ruby and sapphire. As a result, when rays of light incident from the table 51 reach the pavilion 55, most of the rays of light are reflected totally (i.e., the rays of light do not escape the diamond through the pavilion 55, but are reflected inward again), and escape upon reaching the crown 53, thus received by human eyes as brilliancy. The angle of the pavilion 55 is important to total reflection, and the angle of the pavilion 55 is formed normally at 40° ¾' with respect to a horizontal line in FIG. 5(*a*).

The totally reflected rays of light give rise to "dispersion" into seven colors. This is due to the fact that the incident light radiated by a high temperature body such as the sun is composed of a spectrum of colors (which is also referred to as "complex light") even if it appears as white color to the naked eye. The light components having a higher frequency (i.e., the light close to a purple color in the visible spectrum) give a larger refractive index, and conversely, the light components having a lower frequency (i.e., the light close to a red color in the visible spectrum) give a smaller refractive index. Therefore, the difference in color appears as the difference of the refractive index, and the totally reflected rays of light are dispersed into respective colors and present a rainbow in seven colors (the fire).

TABLE 2 shows the relationship between wavelength λ (the reciprocal of frequency f) and a refractive index R.I. of diamond for light of different wavelengths. The difference in the refractive index between purple and red is generally called degree of dispersion D.R.

TABLE 2

| | Wavelength λ[Å] | Refractive Index R.I. |
|---|---|---|
| Red | 6,870 | 2.407 |
| Orange | 5,890 | 2.417 |
| Green | 5,720 | 2.427 |
| Purple | 380 | 2.451 |
| Degree of Dispersion D.R. = 2.451–2.407 = 0.044 | | |

Accordingly, the higher the degree of dispersion becomes, the clearer the divergence of the colors of the spectrum becomes. Further, an increase in accuracy of the angle of the pavilion 55 would increase the frequency of total reflection and give a longer light path inside the diamond (in other words, the effective dimensions of the diamond become larger), and a clearer dispersion so that the fire can be seen more distinctly. The degree of dispersion of 0.044 for a diamond shows this fire beautifully and elegantly to the human eye.

"Scintillation" is a phenomenon in which the reflected light of a diamond moves while glittering in accordance with the movement of the diamond or the movement of the eyes. The scintillation phenomenon depends on the size of the diamond, the number of facets, the polish of the facets, and the accuracy of angles of the respective facets as primary factors.

Figure 6:
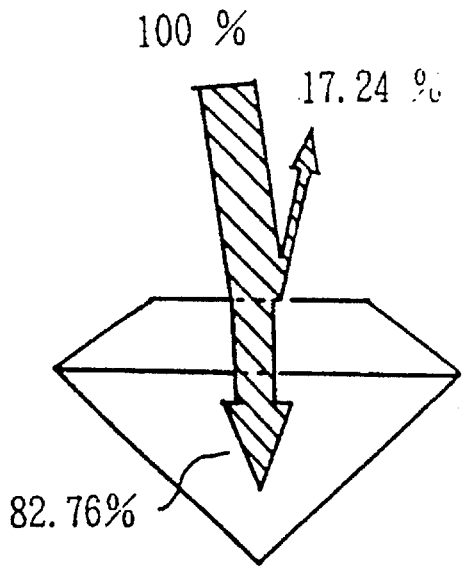
FIG. 6(*a*) and FIG. 6(*b*) are diagrams explaining reflection from a cut jewel surface at incidence angles of 10° and 89°, respectively.
Figure 6:
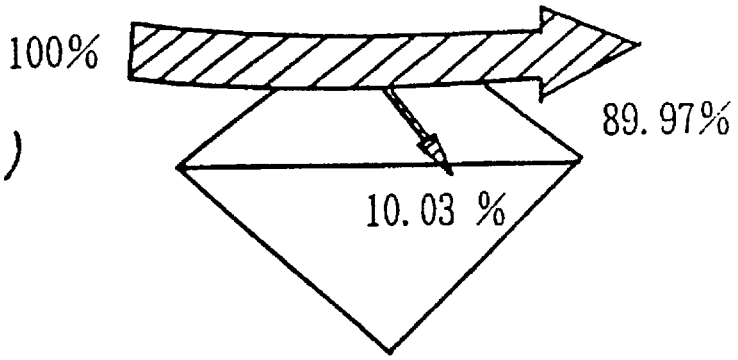

Further, a part of the light incident to a diamond does not enter the diamond, but "is reflected from the surface" of the diamond. As shown in FIGS. 6(*a*) and (*b*), 17.24% of the incident light is reflected from the surface at an incidence angle of 10°, reflection increases with the incidence angle and 89.97% of the incident light is reflected from the surface at an incidence angle of 89°. "Reflection from the surface" depends on the refractive index and the incidence angle of the incident light as primary factors. The reflected light from the surface is generated by the incident light from the outside being reflected as is, and occasionally contains the color of indoor blue carpets and walls, thus further enhancing the beauty of the diamond.

(1) DESCRIPTION OF THE FIRST EMBODIMENT

Figure 1A:
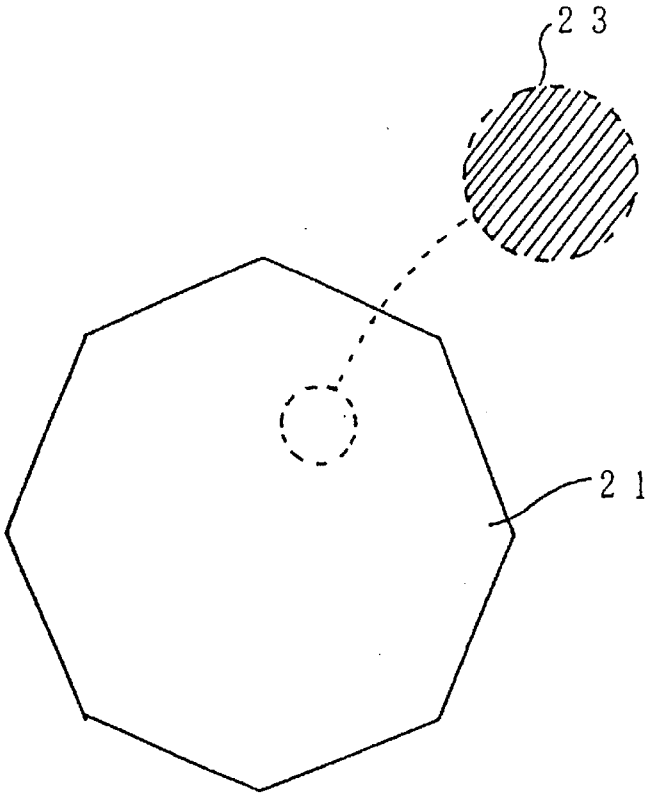
FIG. 1(*a*) shows a plan view and a partial enlarged view of the surface of a table of a brilliant-cut jewel according to a first embodiment of the present invention, and FIG. 1(*b*) is a partial enlarged view showing a vertical section of a part of the surface of the table.
Figure 1B:
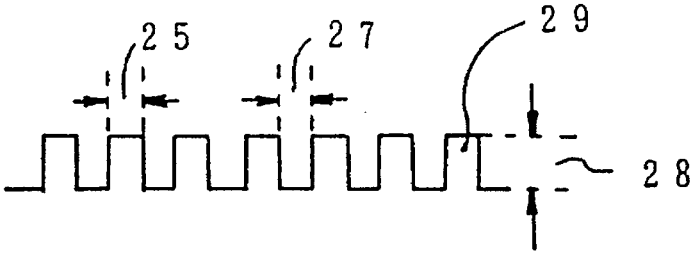

A first embodiment of the present invention is shown in FIG. 1. According to the first embodiment, after preparing a brilliant-cut cubic zirconia of 0.5 carat, fine grooves 23 in a single direction are formed (line working) on the surface of the table 21. This line working is by a lithography method using argon etching which is conventional in the printing industry and the semiconductor manufacturing industry. More specifically, the method involves ultraviolet reduction exposure, development and argon etching.

In the argon etching process, a MILLATRON 8-E Rev. apparatus manufactured by COMMON WEALTH SCIENTIFIC CO., LTD. was used. Further, etching conditions were as follows. Namely, background pressure was $8.0\times10^{-4}$ Pa, working pressure was $2.7\times10^{-2}$ Pa, Ar gas flow rate was 20 sccm, magnet current was 1.6 A, glow current was 6.0 A, extractor voltage and current were 350 V and 0 A, cathode current was 3.3 A, neutralizer current was 14.0 A, ion output voltage and current were 400 V and 0.5 A, stage cooling temperature was 5° C., stage inclination was 90° and working time was 170 sec.

The finished surface of the table 21 has, as shown in FIG. 1(*b*), fine grooves 29 each having a width 27 of approximately 2.5 μm and a depth 28 of approximately 0.2 to 0.3 μm at a mutual spacing 25 of approximately 2.5 μm. The fine grooves 29 are formed in an optional fixed direction and at substantially equal spacings over the total surface of the table 21.

The effects of the present embodiment were confirmed by using a control sample produced under exactly the same conditions as the first embodiment except no processing is applied to the surface of the table 21 of the brilliant-cut and by comparing the sample of the first embodiment with this control sample.

Parallel rays of light were directed onto the sample of the first embodiment and the control sample, using a double arm fiber lighting apparatus made by NIKON corporation. It was seen that the sample of the first embodiment generated stronger dispersion and reflection from its surface as compared with the control sample. Furthermore, it was also noticed that the whole table face shined in red, blue or yellow depending on the direction of the radiated parallel rays of light and the position of one's eyes and a rainbow in seven colors (the fire) was noticed.

Such increase of ornamental effects, i.e. additional brilliancy of the dispersed light, is believed to be due to reflective diffraction and transmission diffraction at the fine grooves formed on the table surface.

(2 ) SECOND EMBODIMENT

Figure 2:
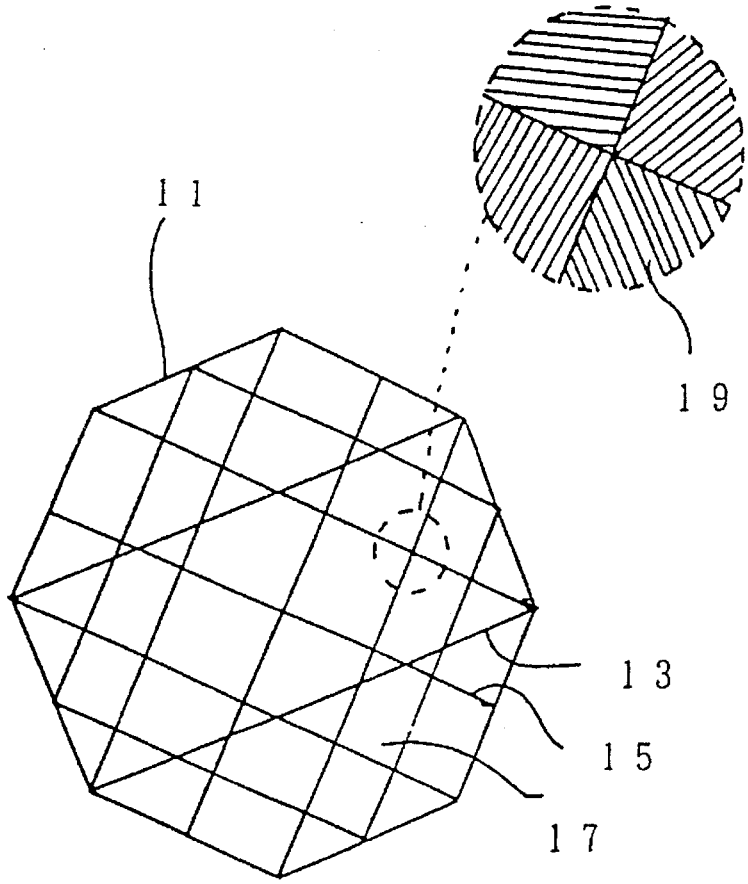
FIG. 2 shows a plan view and a partial enlarged view of the surface of a table of a brilliant-cut jewel according to a second embodiment of the present invention.

A second embodiment of the present invention is shown in FIG. 2. According to the second embodiment, a sample of cubic zirconia of 0.5 carat is brilliant-cut. Thereafter, the surface of an almost octagonal table 11 is carved into a plurality of areas 17 by optional diagonal lines 13 or lines 15 connecting middle points of opposite sides. Fine grooves 19, aligned in directions different from one another, are formed (line working) in respective areas 17. Here, the carving into areas and the line working are performed by etching at the same time. For example, it is possible to prepare a predetermined pattern mask corresponding to FIG. 2 for use in an ultraviolet reduction exposure process for etching.

The conditions of lithography line working are similar to those in the first embodiment. Therefore, the finish of the surface areas 17 of the table 11 is substantially the same as that in the first embodiment as shown in FIG. 1(*b*).

Furthermore, the effects of this second embodiment were confirmed in a similar manner as with the first embodiment. Namely, a control sample was prepared under exactly the same conditions as the second embodiment except no working was applied to the surface of the table 11, for comparison.

When parallel rays of light generated by the double arm fiber lighting apparatus were directed onto the sample of the second embodiment and the control sample from several directions, it was noticed that the sample of the second embodiment generated more intense dispersion and reflection from the surface and greater scintillation. Due to the intense dispersion, a rainbow in seven colors is distinctly visible.

Such enhancement of the ornamental effects is considered to originate in the diffraction light at the fine grooves.

(3) THIRD EMBODIMENT

Figure 3:
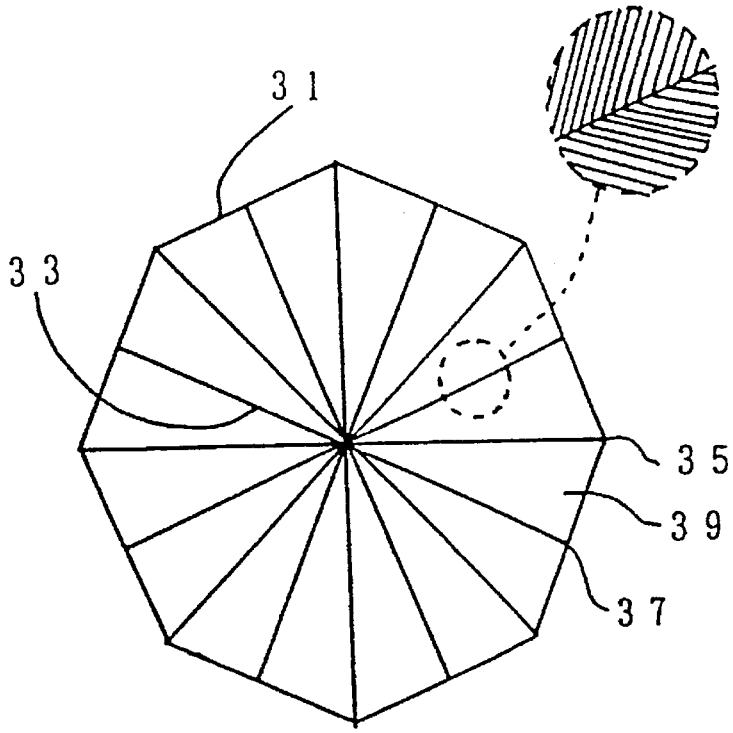
FIG. 3 shows a plan view and a partial enlarged view of the surface of a table of a brilliant-cut jewel according to a third embodiment of the present invention.

A third embodiment of the present invention is shown in FIG. 3. According to the third embodiment, a sample made of cubic zirconia of 0.5 carat was brilliant-cut. Thereafter, the surface of almost octagonal table 31 is divided into a plurality of radial areas 39 by carved lines connecting the center 33 thereof to respective vertical angles 35 or middle points 37 of the sides. Fine grooves are formed in fixed directions which are different as between the respective carved out radial areas 39.

The conditions employed for line working were similar to those used in the first and second embodiments. Therefore, the finish of the surfaces of areas 39 of the table 31 is substantially the same as that of the first embodiment as shown in FIG. 1(*b*).

Furthermore, the effects of this third embodiment were also confirmed in a manner similar to that employed in the first and second embodiments. Namely, a control sample prepared under exactly the same conditions as the third embodiment except that no working was applied to the surface of the table 31 was used for purposes of comparison.

When parallel rays of light generated by a double arm fiber lighting apparatus were directed onto the sample of the third embodiment and the control sample from several directions, it was noticed that the sample of the third embodiment produced more intense dispersion and reflection from the surface as compared with the control sample. Furthermore, it was noticed that the reflected light focused into an image of a crisscross pattern above the table 31 as an effect peculiar to the third embodiment. Further, it was also noticed that the image of the crisscross pattern changed into red, blue or yellow depending on the direction of the parallel rays of light and one's gaze. This effect is considered due to the fact that the areas of fine grooves extend radially.

(4) DESCRIPTION OF OTHER EMBODIMENTS

(a) Light Transmissive Material

As a light transmissive material, all types of transparent and semitransparent jewels, glass and the like presenting a diffraction phenomenon, e.g. as a diamond, glass, plastic and cubic zirconia, may be used.

(b) Cut Configuration of the Light Transmissive Material

Cuts other than the brilliant-cut may be used. Further, it is not necessarily required to form a perfect polyhedron by cutting, as partially curved surfaces are acceptable.

For example, when the present invention is applied to an ornament made of crystal glass having a shape of an animal, a tail is formed with a curved surface and other portions are formed in a polyhedron, and the fine grooves of the present invention are formed at least on one face of the polyhedron. With this, the diffracted light generated on the lined face appears as dispersed light at the other faces of the polyhedron and at the curved surfaces, thus increasing brilliancy.

(c) Configuration and Pattern of Fine Grooves Formed on the Cut Facet

The pattern of the fine grooves is not limited to the patterns of the fine grooves of the first, the second or the third embodiment (FIG. 1(*a*), FIG. 2 or FIG. 3). Further, the dimensions shown with respect to the configuration of individual fine grooves, the depth of the grooves, the spacing between the grooves and other features which are illustrated by way of example are not limiting. When the spacing between the fine grooves is too wide as compared with the wavelength of light, however, interference effects by diffraction are not so conspicuous.

Figure 7:
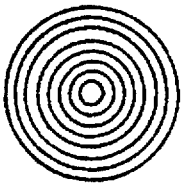
FIG. 7(*a*) shows a pattern of fine grooves formed in concentric circles, and FIG. 7(*b*) shows a pattern of fine grooves formed in waveforms.
Figure 7:
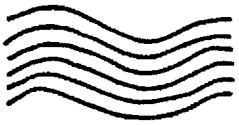

Further, the fine grooves formed in respective areas need not be parallel straight lines as in the foregoing embodiments, but may be formed in concentric circles as shown in FIG. 7(*a*) or in waveforms as shown in FIG. 7(*b*).

(d) Ornaments Enhanced by the Present Invention

The present invention is effective when the jewels described in the first to the third embodiments are used for rings and brooches. Further, the invention is also applicable to an ornament for an alcove made of crystal glass. Furthermore, it is possible to manufacture a chandelier with the present invention, using lightweight plastic materials.

As described above, according to the present invention, it becomes possible to make the most of the glitter of brilliancy, dispersion and scintillation on respective cut facets, thus improving ornamental appearance of jewelry by applying line working to the cut facets of light transmissive materials including jewels.

In order to clarify the present invention and its effects, the present applicant submits color pictures showing that the brilliancy, dispersion, scintillation and reflection from the surface of the samples in the first to the third embodiments are superior as compared with a conventional jewel.

What is claimed is:

1. An ornament of a light transmissive material having a plurality of cut facets, wherein at least one of said cut facets has a plurality of fine grooves, said plurality of fine grooves being spaced over the total surface of said one facet with a substantially equal spacing suitable for the diffraction of visible light entering the ornament through said one facet to form a rainbow of seven colors within said ornament and thereby enhance the appearance of the ornament.

2. An ornament according to claim 1 wherein said spacing is approximately 2.5 microns.

3. An ornament according to claim 1, wherein said light transmissive material is a material selected from the group consisting of a diamond, glass, plastic and a cubic zirconia.

4. An ornament according to claim 1 wherein said fine grooves each have a depth of 0.2–0.3 microns.

5. An ornament according to claim 1 wherein the width of each of said plurality of fine grooves is approximately 2.5 microns.

6. An ornament according to claim 1 wherein said one facet is divided into a plurality of areas wherein the fine grooves in one area of said one facet have a different orientation than the fine grooves in other areas of said one facet adjoining said one area.

7. An ornament according to claim 6 wherein said areas of said one facet extend radially outward from the center of said one facet.

8. An ornament according to claim 1 wherein said fine grooves are parallel lines.

9. An ornament according to claim 1 wherein said fine grooves are formed as concentric circles.

10. An ornament according to claim 1 wherein said fine grooves form a waveform pattern.

11. An ornament according to claim 1 wherein said fine grooves form a pattern of parallel lines, concentric circles or waveforms.

12. An ornament according to claim 1 wherein said ornament is in the form of a brilliant-cut having a table facet, a plurality of crown facets, a plurality of pavilion facets and a girdle.

13. An ornament according to claim 12 wherein said one facet is said table facet.

* * * * *